US006395679B1

(12) United States Patent
Takeuchi

(10) Patent No.: US 6,395,679 B1
(45) Date of Patent: May 28, 2002

(54) HEAT-SENSITIVE RECORDING MATERIAL AND METHOD FOR PRODUCING THE SAME

(75) Inventor: Koh Takeuchi, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 29 days.

(21) Appl. No.: 09/595,441

(22) Filed: Jun. 16, 2000

(30) Foreign Application Priority Data

Jun. 16, 1999 (JP) ..... 11-169287

(51) Int. Cl.[7] ..... B41M 5/40
(52) U.S. Cl. ..... 503/200; 427/152; 503/226
(58) Field of Search ..... 427/152; 503/200, 503/226

(56) References Cited

U.S. PATENT DOCUMENTS 6,261,993 B1 * 7/2001 Aono ..... 503/226

FOREIGN PATENT DOCUMENTS

JP 8-230323 9/1996

OTHER PUBLICATIONS

Patent Abstract of Japan 08230323 Oct. 9, 1996.

* cited by examiner

*Primary Examiner*—Bruce Hess
(74) *Attorney, Agent, or Firm*—Sughrue Mion, PLLC

(57) ABSTRACT

A heat-sensitive recording material is provided which has an excellent head matching performance and a surface which is coated well without any coating defects. A method for producing the heat-sensitive material is also provided. The heat-sensitive recording material includes a substrate, and a heat-sensitive recording layer and a protective layer disposed on the substrate in that order. The protective layer is formed by applying a coating solution for the protective layer containing a pigment, a binder, and an emulsion of silicone oil dispersed so that an average particle diameter of silicone oil is 0.15 $\mu$m or less. It is preferable that the silicone oil is at least one type of silicone oil selected from the group consisting of ether modified silicone oil, carboxy modified silicone oil and amino modified silicone oil. Further, it is preferable that the silicone oil has a viscosity within a range from 400 to 100,000 cps.

20 Claims, No Drawings

HEAT-SENSITIVE RECORDING MATERIAL AND METHOD FOR PRODUCING THE SAME

BACKGROUND OF THE INVENTION

1. Field of the Invention

The present invention relates to a heat-sensitive recording material and a method for producing the same, and more specifically, to a heat-sensitive recording material which provides high quality images suitable for a recording medium used in the medical field and the like, and a method for producing the same.

2. Description of the Related Art

In recent years, heat-sensitive recording methods have come to be used more often in various fields because the methods have advantages such as: (1) developing processing is not necessary; (2) recording materials having a quality close to that of general use paper are obtained when paper is used as the substrate of the recording material; (3) handling is easy; (4) the densities of the formed colors are high; (5) simple, reliable and inexpensive recording apparatuses can be used; (6) noise is not generated during recording; and (7) no particular maintenance is required. Application of heat-sensitive recording methods is expanding, for example, to the fields of facsimiles, printers and the like and to the field of labels such as POS.

As a heat-sensitive recording material used for the heat-sensitive recording, heat-sensitive recording materials utilizing the reaction of colorless electron-donating dyes and electron-accepting compounds, heat-sensitive recording materials utilizing the reaction of diazo compounds and couplers, and the like have been widely known.

Under these circumstances, the development of a transparent heat-sensitive recording material which can be recorded directly by a thermal head has come to be desired recently so that the demand for recording multicolor images can be satisfied or recorded images can be projected by an overhead projector or can be directly observed on a light table.

Therefore, it has been proposed that a heat-sensitive recording material be prepared by disposing, on a transparent substrate such as a film of a synthetic polymer substance, a heat-sensitive recording layer which is formed by dispersing, in a binder as fine particles, a substantially colorless color forming component A and a substantially colorless color forming component B which forms color by reacting with the color forming component A or by microencapsulating either one of components A and B and using the other component in the form of an emulsion.

Although such a transparent heat-sensitive recording material has good transparency, there has been a drawback with the heat-sensitive recording material in that sticking tends to occur and noise tends to be generated when the heat-sensitive recording material is used for forming images by using a heat-sensitive recording apparatus such as a thermal recording printer. For the purpose of improving matching performance of such a thermal head, attempts have been made to provide a protective layer, which contains a pigment and a binder as main components, on the heat-sensitive recording layer of the heat-sensitive recording material, and to include various types of lubricants in the protective layer. However, a heat-melting lubricant such as derivatives of higher fatty acids has drawbacks such as: (1) the lubricant has insufficient lubricating property in regions in which the thermal energy is less than the amount required for melting; and (2) after being melted by thermal recording, the lubricant recrystallizes and the surface thereof whitens (i.e., bleeding is caused). On the other hand, when a liquid lubricant at an ordinary temperature is used, it is necessary to emulsify the lubricant to be added to the coating solution for the protective layer. Accordingly, there is a problem with liquid lubricants in that the emulsion is damaged by shear when passing through a pump or a filter while the liquid is being fed or is damaged by an ultrasonic deaerator, thereby resulting in minute coating defects due to repelling. When the image formed on such a heat-sensitive material is used for medical purposes, there is a risk that such coating defects may make diagnosis difficult and thus, improvements have been desired. The present situation is that a satisfactory heat-sensitive recording material having an excellent head matching performance and a surface which is coated well without any coating defects has not yet been achieved.

SUMMARY OF THE INVENTION

A purpose of the present invention is to solve the above-described conventional problems and to achieve the following objects. That is, an object of the present invention is to provide a heat-sensitive recording material having an excellent head matching performance and a surface which is coated well without any coating defects. Another object of the present invention is to provide a method for producing such a heat-sensitive recording material.

As a result of diligent studies on lubricants contained in protective layers by the present inventors trying to improve head matching performance and to eliminate coating defects, it was found that an emulsion of silicone oil dispersed so as to have a specific particle diameter or less has excellent head matching performance, a good stability against external stimuli such as mechanical shear or ultrasonic waves, and an extremely low incidence of coating defects. The present invention has been completed on the basis of these findings.

The present invention provides a heat-sensitive recording material comprising a substrate, and a heat-sensitive recording layer and a protective layer disposed on the substrate in that order, wherein the protective layer is formed by applying a coating solution for the protective layer containing a pigment, a binder, and an emulsion of silicone oil, wherein the silicone oil is dispersed so that an average particle diameter of the silicone oil is 0.15 $\mu$m or less.

In another aspect, the present invention provides a heat-sensitive recording material, wherein the silicone oil satisfies a relational expression $d2/d1 \leqq 1.5$, where d1 is the average particle diameter of the silicone oil in the emulsion and d2 is the average particle diameter of the silicone oil after the emulsion of the silicone oil is diluted 50 fold with water.

In still another aspect, the present invention provides a heat-sensitive recording material, wherein the silicone oil satisfies a relational expression $d3/d1 \leqq 1.5$, where d1 is the average particle diameter of the silicone oil in the emulsion and d3 is the average particle diameter of the silicone oil after the emulsion of the silicone oil is diluted 50 fold with water and then irradiated by ultrasonic waves with an output power of 100 W at 40 Hz for 30 minutes.

In still another aspect, the present invention provides a heat-sensitive recording material, wherein the silicone oil satisfies a relational expression $d4/d1 \leqq 1.5$, where d1 is the average particle diameter of the silicone oil in the emulsion and d4 is the average particle diameter of the silicone oil after the emulsion of the silicone oil is diluted 50 fold with water and then stirred by a homogenizer at 5000 rpm for 10 minutes.

In still another aspect, the present invention provides a heat-sensitive recording material, wherein the silicone oil is at least one type of silicone oil selected from the group consisting of ether modified silicone oil, carboxy modified silicone oil and amino modified silicone oil.

In still another aspect, the present invention provides a heat-sensitive recording material, wherein the silicone oil has a viscosity within a range from 400 to 100,000 cps.

In still another aspect, the present invention provides a method for producing a heat-sensitive recording material including the steps of:

(a) forming a heat-sensitive recording layer on a substrate by applying a coating solution for forming the heat-sensitive recording layer; and (b) forming a protective layer on the heat-sensitive recording layer by applying another coating solution for forming the protective layer containing at least a pigment and a binder, wherein the coating solution for forming the protective layer contains an emulsion of silicone oil, wherein the silicone oil is dispersed so that an average particle diameter of the silicone oil is 0.15 μm or less.

DETAILED DESCRIPTION OF THE PREFERRED EMBODIMENTS

A detailed description will be given hereinafter of a heat-sensitive recording material of the present invention.

The heat-sensitive recording material of the present invention is formed by providing a heat-sensitive recording layer and a protective layer on a substrate in that order, and other layers if necessary.

Protective Layer

The protective layer is formed on the heat-sensitive recording layer, or on an intermediate layer if the intermediate layer is provided as the above-mentioned other layer on the heat-sensitive recording layer.

The protective layer is formed by applying a coating solution for the protective layer. The coating solution for the protective layer contains at least a pigment and a binder. Further, in order to improve head matching performance and to obtain an excellent coated surface, the coating solution for the protective layer contains an emulsion of silicone oil, which is dispersed so that the average particle diameter thereof is 0.15 μm or less (the dispersed silicone oil will be occasionally simply referred to as the "silicone oil", hereinafter). The coating solution for the protective layer contains other components if necessary.

(Silicone Oil)

While the silicone oil used in the present invention is dispersed so that the average particle diameter thereof is 0.15 μm or less, the average particle diameter is preferably 0.10 μm or less, and more preferably 0.08 μm or less. If the average particle diameter exceeds 0.15 μm, the emulsion of the silicone oil is damaged by strong stirring or ultrasonic irradiation, and huge oil droplets are formed. Accordingly, coating defects due to repelling may be caused easily. In the present invention, the average particle diameter of the silicone oil is indicated by values measured by a submicron particle analyser (N4-type, manufactured by Coulter, Inc.).

The silicone oil used in the present invention is not particularly limited as long as the silicone oil is dispersed so that the average particle diameter thereof is 0.15 μm or less, and commercially available products may be used. Silicone oil whose average particle diameter exceeds 0.15 μm can also be used in the present invention by dispersing the silicone oil thoroughly so that the average particle diameter becomes 0.15 μm or less.

In order to disperse the silicone oil such that the average particle diameter thereof becomes 0.15 μm or less, a conventional dispersing machine such as a homogenizer, a dissolver, a colloid mill, or an ultrasonic emulsifier is used in the presence of an auxiliary dispersant such as polyvinyl alcohol or any of various types of surfactants, preferably a nonionic surfactant or alkylbenzene sulfonate. In such a manner, the silicone oil can be dispersed such that the average particle diameter thereof is within the above-described range.

For the silicone oil used in the present invention, d2/d1 is preferably 1.5 or less, and more preferably 1.2 or less, where d1 is the average particle diameter of an emulsion of the silicone oil and d2 is the average particle diameter of the silicone oil after the emulsion of the silicone oil is diluted 50 fold by weight with water. If d2/d1 exceeds 1.5, defects due to repelling may be caused during coating.

Moreover, for the silicone oil used in the present invention, d3/d1 is preferably 1.5 or less, and more preferably 1.2 or less, where d1 is the average particle diameter of an emulsion of the silicone oil and d3 is the average particle diameter of the silicone oil after the emulsion of the silicone oil is diluted 50 fold with water and irradiated by ultrasonic waves with an output power of 100 W at 40 Hz for 30 minutes. If d3/d1 exceeds 1.5, defects due to repelling may be caused during coating.

Further, for the silicone oil used in the present invention, d4/d1 is preferably 1.5 or less, and more preferably 1.2 or less, where d1 is the average particle diameter of an emulsion of the silicone oil and d4 is the average particle diameter of the silicone oil after the emulsion of the silicone oil is diluted 50 fold with water and stirred by a homogenizer at 5000 rpm for 10 minutes. If d4/d1 exceeds 1.5, defects due to repelling may be caused during coating.

While an ordinary polydimethylsiloxane can be used for the silicone oil, ether modified silicone oil, carboxy modified silicone oil, amino modified silicone oil, carbinol modified silicone oil, phenol modified silicone oil, and mercapto modified silicone oil are preferable, and ether modified silicone oil, carboxy modified silicone oil, and amino modified silicone oil are more preferable. A single type of silicone oil or a combination of two or more types of silicone oils may be used. These modified silicone oils may be modified at the side chain or at the terminal of the molecule.

The viscosity of the silicone oil used in the present invention is preferably 400 to 100,000 cps, and more preferably 1,000 to 50,000 cps. If the viscosity is lower than 400 cps, the surface of the protective layer feels sticky to the touch, and fingerprints may be left when the surface is touched by fingers. On the other hand, if the viscosity exceeds 100,000 cps, it is difficult to emulsify and disperse the silicone oil to the extent that an average particle diameter of 0.15 μm or less is achieved.

The added amount of the silicone oil used in the present invention is preferably 1 to 15% by weight and more preferably 2 to 10% by weight based on the total coating amount of the protective layer. If the added amount is less than 1% by weight, it may not be possible to obtain the effect of providing lubricating property with respect to the head. On the other hand, if the added amount exceeds 15% by weight, further effects may not be expected. Besides, ill effects such as fouling on the head might be caused.

(Pigment)

The pigment is generally used to enable recording by a thermal head to be carried out better. Specifically, the pigment is used to reduce sticking and generation of noise and the like. It is preferable that an organic and/or inorganic pigment is used.

It is preferable that the pigment used in the protective layer is a pigment in which 50% by volume of the total volume of particles in the pigment is particles having a volume average particle diameter of 0.20 to 1.00 μm. This "50% volume average particle diameter" thus refers to the average diameter of 50% by volume of all of the particles of the pigment, and is measured by an apparatus for measuring distribution of particle diameters by laser diffraction, LA700, manufactured by Horiba Ltd. Hereinafter, the average particle diameter of 50% by volume of the total volume of the particles will upon occasion be simply referred to as the "average particle diameter". It is more preferable that the 50% volume average particle diameter of the pigment is in a range of 0.20 to 0.50 μm to prevent sticking and generation of noise and the like between a thermal head and the heat-sensitive recording material during recording by using the thermal head.

When the 50% volume average particle diameter of the particles exceeds 1.00 μm, the effect of reducing wear of a thermal head decreases. When the 50% volume average particle diameter is less than 0.20 μm, the effect of addition of the pigment, i.e., the effect of preventing adhesion caused by the binder in the protective layer fusing to the thermal head, decreases, and, as a result, so-called sticking, i.e., adhesion of the protective layer of the heat-sensitive recording material to the thermal head, takes place during printing. Therefore, such average particle diameters are not preferable.

The pigment contained in the protective layer is not particularly limited and conventional organic and inorganic pigments can be used. Preferable examples of the pigment include inorganic pigments such as calcium carbonate, titanium oxide, kaolin, aluminum hydroxide, amorphous silica and zinc oxide; and organic pigments such as urea-formaldehyde resins and epoxy resins. Among these pigments, kaolin, aluminum hydroxide and amorphous silica are more preferable. A single type of the pigment or a combination of two or more types of the pigments may be used.

Particularly preferable examples among these pigments include inorganic pigments obtained by coating the surface of the pigment particle with at least one type of compound selected from the group consisting of higher fatty acids, metal salts of higher fatty acids, higher alcohol, and amides of higher fatty acids.

Examples of the higher fatty acids include stearic acid, palmitic acid, myristic acid, lauric acid and the like.

These pigments are preferably dispersed by a conventional dispersing machine such as a dissolver, a sand mill, or a ball mill in the presence of an auxiliary dispersant such as sodium hexametaphosphate, partially or fully saponified modified polyvinyl alcohol, copolymers of polyacrylic acid, and various types of surfactants, preferably a partially or fully saponified modified polyvinyl alcohol or an ammonium salt of a copolymer of polyacrylic acid in such a manner that the average particle diameter has the above-described value, and then used. That is, it is preferable that the pigment is dispersed before use such that the 50% volume average particle diameter of the pigment particles is in the range of 0.20 to 1.00 μm.

(Binder)

To achieve excellent transparency, it is preferable that fully saponified polyvinyl alcohol, carboxy modified polyvinyl alcohol, silica modified polyvinyl alcohol or the like is used as the binder for the protective layer.

(Other Components)

The protective layer may contain conventional film hardeners, metal soaps, and the like.

To form a uniform protective layer on the heat-sensitive recording layer, or on the intermediate layer, it is preferable that a surfactant is added to a coating solution for forming the protective layer. Examples of the surfactant include alkali metal salts of sulfosuccinic acid and fluorine-containing sufractants and the like. Specific examples of the surfactant include sodium salts or ammonium salts of di-(2-ethylhexyl) sulfosuccinate, di-(n-hexyl) sulfosuccinate and the like.

Further, to the protective layer, waxes may be added to reduce wear of a recording head, and surfactants, fine particles of metal oxides, inorganic electrolytes, macromolecular electrolytes and the like may be added to prevent electrostatic charge on the heat-sensitive recording material.

The wax preferably has a melting point in the range of 40 to 100° C. and a 50% volume average particle diameter of 0.7 μm or less and more preferably of 0.4 μm or less.

When the average particle diameter exceeds 0.7 μm, transparency of the protective layer deteriorates or obtained images do not come out clearly. Therefore, such a diameter is not preferable.

When the melting point is lower than 40° C., the surface of the protective layer becomes tacky. When the melting point exceeds 100° C., sticking tends to take place. Therefore, such melting points are not preferable.

As the wax having a melting point of 40 to 100° C., petroleum waxes such as paraffin wax and microcrystalline wax, synthetic waxes such as polyethylene wax, plant waxes such as candelilla wax, carnauba wax and rice wax, animal waxes such as lanolin, and mineral waxes such as montan wax, can be used. Among these waxes, paraffin wax having a melting point of 55 to 75° C. is particularly preferable.

The wax is preferably used in an amount of 0.5 to 40% by weight and more preferably in an amount of 1 to 20% by weight of the total amount of the protective layer. The wax may be used in combination with derivatives of 12-hydroxystearic acid, higher fatty acid amides, or the like.

To obtain a dispersion of the wax having the above-described 50% volume average particle diameter, the wax may be dispersed by using a conventional wet type dispersing machine such as a dynomill and a sand mill in the presence of a suitable protective colloid and/or a suitable surfactant. A method in which the wax is heated to melt and then emulsified by stirring at a high speed or by ultrasonic dispersion in a solvent in which the wax is insoluble or slightly soluble at a temperature not lower than the melting point of the wax, or a method in which the wax is dissolved in a suitable solvent and then emulsified in a solvent in which the wax is insoluble or slightly soluble, can also be used to obtain a dispersion having small particles. A suitable surfactant or a suitable protective colloid may be used in combination in the above methods.

The protective layer may have a single layer structure or a laminate structure having two or more layers. The coated amount of the dried protective layer is preferably 0.2 to 7 $g/m^2$ and more preferably 1 to 4 $g/m^2$.

Heat-Sensitive Recording Layer

The heat-sensitive recording layer contains at least a color forming component, and other components if necessary.

(Color Forming Component)

The heat-sensitive recording layer may have any composition as long as the layer has excellent transparency before color development and develops color by heating.

Examples of the heat-sensitive recording layer include a so-called two-component heat-sensitive recording layer containing a substantially colorless color forming component A and a substantially colorless color forming component B which forms color by reaction with the color forming component A. It is preferable that either one of the color forming components A and B is micro-encapsulated. Examples of combinations of two components constituting the two-component heat-sensitive recording layer include the following combinations (a) to (m):

(a) Combinations of electron-donating dye precursors with electron-accepting compounds.

(b) Combinations of photodecomposable diazo compounds with couplers.

(c) Combinations of organic metal salts such as silver behanate and silver stearate with reducing agents such as protocatechuic acid, spiroindane and hydroquinone.

(d) Combinations of long chain aliphatic salts such as ferric stearate and ferric myristate with phenols such as gallic acid and ammonium salicylate.

(e) Combinations of heavy metal salts of organic acids such as nickel, cobalt, lead, copper, iron, mercury or silver salt of acetic acid, stearic acid and palmitic acid with alkaline earth metal sulfides such as calcium sulfide, strontium sulfide and potassium sulfide, or combinations of the above heavy metal salts of organic acids with organic chelating agents such as s-diphenylcarbazide and diphenylcarbazone.

(f) Combinations of metal sulfates such as silver sulfide, lead sulfide, mercury sulfide and sodium sulfide with sulfur compounds such as sodium tetrathionate, sodium thiosulfate and thiourea.

(g) Combinations of aliphatic ferric salts such as ferric stearate with aromatic polyhydroxy compounds such as 3,4-dihydroxytetraphenylmethane.

(h) Combinations of organic noble metal salts such as silver oxalate and mercury oxalate with organic polyhydroxy compounds such as polyhydroxyalcohol, glycerol and glycol.

(i) Combinations of aliphatic ferric salts such as ferric peralgonate and ferric laurate with derivatives of thiocetylcarbamide and isothiocetylcarbamide.

(j) Combinations of lead salts of organic acids such as lead capronate, lead peralgonate and lead behenate with derivatives of thiourea such as ethylenethiourea and N-dodecylthiourea.

(k) Combinations of heavy metal salts of higher fatty acids such as ferric stearate and copper stearate with zinc dialkyldithiocarbamate.

(l) Combinations forming oxazine dyes such as combination of resorcinol and nitroso compounds.

(m) Combinations of formazane compounds with reducing agents and/or metal salts.

In the heat-sensitive recording material of the present invention, the combinations (a) of electron-donating dye precursors with electron-accepting compounds, combinations (b) of photodecomposable diazo compounds with couplers, or combinations (c) of organic metal salts with reducing agents are preferable. The combinations (a) of electron-donating dye precursors with electron-accepting compounds and the combinations (b) of photodecomposable diazo compounds with couplers are particularly preferable.

In the heat-sensitive recording material of the present invention, images having excellent transparency can be obtained by forming a heat-sensitive recording layer so as to have a decreased haze value which is obtained from the calculation (diffused light transmittance/total light transmittance)×100(%). The haze value is an index showing the transparency of a material and is generally calculated from the total light transmittance, the diffused light transmittance and the specular light transmittance obtained by using a haze meter.

In the present invention, the haze value can be decreased by a method in which the volume average particle diameter of 50% by volume of each of color forming components A and B contained in the heat-sensitive recording layer is adjusted to 1.0 $\mu$m or less and preferably to 0.6 $\mu$m or less and a binder is contained in an amount in the range of 30 to 60% by weight of the total solid components of the heat-sensitive recording layer, or by a method in which one of the color forming components A and B is micro-encapsulated and the other is used in a form which forms a substantially continuous layer after application and drying, for example, is used in the form of an emulsion.

It is also effective if the refractivity indices of the components used in the heat-sensitive recording layer are adjusted to be as close to a specific value as possible.

The combinations (a), (b) and (c) which are preferably used in the heat-sensitive recording layer are described in detail hereinafter.

(a) The heat-sensitive recording layer using the combination of an electron-donating dye precursor and an electron-accepting compound is described hereinafter.

The electron-donating dye precursor preferably used in the present invention is not particularly limited as long as the precursor is substantially colorless. The electron-donating dye precursor is a compound having the property of developing color by donating an electron or by accepting a proton from an acid or the like. A colorless compound having a partial skeleton structure of lactone, lactum, sultone, spiropyran, ester or amide which causes an open ring or cleavage of the structure when the compound is brought into contact with an electron-accepting compound is preferably used.

Examples of the electron-donating dye precursor include triphenylmethane phthalide compounds, fluoran compounds, phenothiazine compounds, indolyl phthalide compounds, leuko auramine compounds, rhodamine lactum compounds, triphenylmethane compounds, triazine compounds, spiropyran compounds, fluorene compounds, pyridine compounds and pyrazine compounds.

Specific examples of the phthalide compound include compounds described in U.S. Reissued Pat. No. 23,024 and U.S. Pat. Nos. 3,491,111, 3,491,112, 3,491,116 and 3,509,174.

Specific examples of the fluoran compound include compounds described in U.S. Pat. Nos. 3,624,107, 3,627,787, 3,641,011, 3,462,828, 3,681,390, 3,920,510 and 3,959,571.

Specific examples of the spiropyran compounds include compounds described in U.S. Pat. No. 3,971,808.

Specific examples of the pyridine compound and the pyrazine compound include compounds described in U.S. Pat. Nos. 3,775,424, 3,853,869 and 4,246,318.

Specific examples of the fluorene compound include compounds described in Japanese Patent Application No. 61-240989.

In particular, 2-arylamino-3-[H, halogen, alkyl or alkoxy-6-substituted aminofluorans] which form black color are preferable among the above compounds.

Specific examples of the above compound include 2-anilino-3-methyl-6-diethylaminofluoran, 2-anilino-3-methyl-6-N-cyclohexyl-N-methylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-anilino-3-methyl-6-N-ethyl-N-isoamylaminofluoran, 2-anilino-3-methyl-6-N-ethyl-N-dodecylaminofluoran, 2-anilino-3-methoxy-6-dibutylaminofluoran, 2-o-chloroanilino-6-dibutylaminofluoran, 2-p-chloroanilino-3-ethyl-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-o-toluidino-3-methyl-6-diisopropylaminofluoran, 2-anilino-3-methyl-6-N-isobutyl-N-ethylaminofluoran, 2-anilino-3-methyl-6-N-ethyl-N-tetrahydrofurfurylaminofluoran, 2-anilino-3-chloro-6-N-ethyl-N-isoamylaminofluoran, 2-anilino-3-methyl-6-N-methyl-N-γ-ethoxypropylaminofluoran, 2-anilino-3-methyl-6-N-ethyl-N-γ-ethoxypropylaminofluoran and 2-anilino-3-methyl-6-N-ethyl-N-γ-propoxypropylaminofluoran.

Examples of the electron-accepting compound which interacts with the electron-donating dye precursor include acidic substances such as phenol compounds, organic acids, metal salts of organic acids, and esters of oxybenzoic acid, for example, the compounds described in Japanese Patent Laid-Open (hereinafter abbreviated as JP-A) No. 61-291183.

Specific examples of the electron-accepting compound include:

bisphenols such as 2,2-bis(4'-hydroxyphenyl)propane (generic name: bisphenol A), 2,2-bis(4'-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'-hydroxyphenyl)propane, 1,1-bis(4'-hydroxyphenyl)butane, 1,1-bis(4'-hydroxyphenyl)pentane, 1,1-bis(4,hydroxyphenyl)hexane, 1,1-bis(4'-hydroxyphenyl)heptane, 1,1-bis(4'-hydroxyphenyl)octane, 1,1-bis(4'-hydroxyphenyl)-2-methyl-pentane, 1,1-bis(4'-hydroxyphenyl)-2-ethyl-hexane, 1,1-bis(4'-hydroxyphenyl)dodecane, 1,4-bis(p-hydroxyphenylcumyl)benzene, 1,3-bis(p-hydroxyphenylcumyl)benzene, bis(p-hydroxyphenyl)sulfone, bis(3-allyl-4-hydroxyphenyl)sulfone and benzyl bis(p-hydroxyphenyl)acetate;

derivatives of salicylic acid such as 3,5-di-α-methylbenzylsalicylic acid, 3,5-di-tert-butylsalicylic acid, 3-α-α-dimethylbenzylsalicylic acid and 4-(β-p-methoxyphenoxyethoxy)salicylic acid;

salts of the derivatives of salicylic acid with multi-valent metals particularly zinc and aluminum; esters of oxybenzoic acid such as benzyl p-hydroxybenzoate, 2-ethylhexyl p-hydroxybenzoate, 2-phenoxyethyl β-resorcylate; and phenols such as p-phenylphenol, 3,5-diphenylphenol, cumylphenol, 4-hydroxy-4'-isopropoxy-diphenylsulfone and 4-hydroxy-4'-phenoxy-diphenylsulfone.

Bisphenols are preferable among these compounds from the standpoint of obtaining an excellent color developing property.

A single type or a combination of two or more types of the above electron-accepting compounds may be used.

(b) The combination of a photodecomposable diazo compound and a coupler is described hereinafter.

The photodecomposable diazo compound develops a desired color by the coupling reaction with a coupler which is a coupling component described later. When light having a wavelength of a specific range is irradiated onto the photodecomposable diazo compound before the coupling reaction, the photodecomposable diazo compound is decomposed and loses the ability to develop color even in the presence of the coupling component.

The color hue of this coloring system is decided by the diazo dye produced by the reaction of the diazo compound with the coupler. Therefore, the developed hue can be changed easily by changing the chemical structure of the diazo compound or the coupler. Thus, a desired hue can be obtained by selecting a suitable combination of the diazo compound and the coupler.

As the photodecomposable diazo compound used in the present invention, aromatic diazo compounds are preferable. Specifically, aromatic diazonium salts, diazosulfonate compounds and diazoamino compounds are preferable.

The aromatic diazonium salt may be a compound represented by the following formula:

$$Ar—N_2^+X^-$$

wherein Ar represents a substituted or unsubstituted aromatic hydrocarbon ring group, $N_2^+$ represents a diazonium group and $X^-$ represents an acid anion. However, the aromatic diazonium compound is not particularly limited thereto. Aromatic diazonium compounds which exhibit an excellent photofixing property, cause little color stains after fixing and form a stable color developed portion are preferably used.

Many diazosulfonate compounds have come to be known recently and can be obtained by treating corresponding diazonium salts with a sulfite. These compounds are advantageously used in the heat-sensitive recording material of the present invention.

The diazoamino compound can be obtained by coupling a diazo group with dicyandiamide, sarcosine, methyltaurine, N-ethylanthranic acid-5-sulfonic acid, monoethanolamine, diethanolamine or guanidine, and is advantageously used in the heat-sensitive recording material of the present invention.

These diazo compounds are described in detail, for example, in JP-A 2-136286.

Examples of the coupler which is used for the coupling reaction with the above diazo compound include 2-hydroxy-3-naphthoic acid anilide, resorcinol and other compounds described in JP-A 62-146678 and the like.

When the diazo compound and the coupler are used in combination in the heat-sensitive recording layer, a basic substance may be added as the sensitizer to accelerate the reaction by carrying out the coupling reaction in a basic atmosphere.

As the basic substance, a basic substance which is insoluble or slightly soluble in water or which generates an alkali upon heating can be used. Examples of the basic substance include compounds containing nitrogen such as inorganic or organic ammonium salts, organic amines, amides, urea, thiourea, derivatives of urea and thiourea, thiazoles, pyrrols, pyrimidines, piperazines, guanidines, indols, imidazoles, imidazolines, triazoles, morpholines, piperidines, amidines, formazines and pyridines.

Specific examples of these compounds include compounds described in JP-A 61-291183.

(c) The combination of an organic metal salt and a reducing agent is described hereinafter.

Specific examples of the organic metal salt include silver salts of long chain aliphatic carboxylic acids such as silver laurate, silver myristate, silver palmitate, silver stearate, silver arachate and silver behenate; silver salts of organic compounds having imino group such as silver salt of benzotriazole, silver salt of benzimidazole, silver salt of cabazole and silver salt of phthaladinone; silver salts of compounds containing sulfur such as s-alkyl thioglycolates; silver salts of aromatic carboxylic acids such as silver benzoate and silver phthalate; silver salts of sulfonic acids such as silver ethanesulfonate; silver salts of sulfinic acids such as silver o-toluenesulfinate; silver salts of phosphoric acids such as silver phenylphosphate; silver barbiturate; silver saccharinate; silver salt of salicylaldoxime; and mixtures of these compounds.

Among these compounds, silver salts of long chain aliphatic carboxylic acids are preferable and silver behenate is more preferable. Behenic acid may be used in combination with silver behenate.

As the reducing agent, suitable compounds may be used with reference to the descriptions from the 14th line in the lower left column of page 227 to the 11th line in the upper right column of page 229 in the specification of JP-A 53-1020. Among such compounds, mono-, bis-, tris- and tetrakis-phenols, mono- and bis-naphthols, di- and polyhydroxy-naphtalenes, di- and polyhydroxybenzenes, hydroxymonoethers, ascorbic acids, 3-pyrazolidones, pyrazolines, pyrazolones, reducing sugars, phenylenediamines, hydroxylamines, reductons, hydroxamines, hydrazides, amidoximes and N-hydroxyureas are preferably used.

Among these compounds, aromatic organic reducing agents such as polyphenols, sulfonamidophenols and naphthols are more preferable.

To surely achieve sufficient transparency of the heat-sensitive recording material, it is preferable that the combination (a) of an electron-donating dye precursor and an electron-accepting compound or the combination (b) of a photodecomposable diazo compound and a coupler is used for the heat-sensitive recording layer. It is also preferable that either one of the color forming components A and B is used in the form of microcapsules, and it is more preferable that the electron-donating dye precursor or the photodecomposable diazo compound is used in the form of microcapsules.

(Microcapsules)

The method for producing microcapsules is described in detail hereinafter.

Microcapsules can be produced by interfacial polymerization, internal polymerization, external polymerization or the like, and any of these methods can be used.

As described above, it is preferable that the electron-donating dye precursor or the photodecomposable diazo compound is micro-encapsulated for the heat-sensitive recording material. In particular, interfacial polymerization is preferable. Interfacial polymerization is carried out as follows: an oil phase is prepared by dissolving or dispersing the electron-donating dye precursor or the photodecoposable diazo compound, which forms the core of the capsule, in a hydrophobic organic solvent; the prepared oil phase is mixed with an aqueous phase in which a water-soluble polymer is dissolved; the two phases are emulsified and dispersed with each other by a device such as a homogenizer; a polymer substance is formed at the interface of the oil droplets by the reaction induced by heating; and the walls of microcapsules of the polymer are formed.

The reactants for forming the polymer substance are added to the inside and/or the outside of the oil droplets. Specific examples of the polymer substance include polyurethanes, polyureas, polyamides, polyesters, polycarbonates, urea-formaldehyde resins, melamine resins, polystyrenes, styrene-methacrylate copolymers and styrene-acrylate copolymers. Among these polymer substances, polyurethanes, polyureas, polyamides, polyesters and polycarbonates are preferable and polyurethanes and polyureas are more preferable.

For example, when a polyurea is used as the wall material of the microcapsule, the wall of the microcapsule can be easily formed by allowing to react a polyisocyanate such as a diisocyanate, a triisocyanate, a tetraisocyanate and a polyisocyanate prepolymer with a polyamine such as a diamine, a triamine and a tetramine, a prepolymer having two or more amino groups, piperadine, a derivative of piperadine, a polyol or the like in the aqueous phase by the interfacial polymerization method.

A composite wall composed of a polyurea and a polyamide or a composite wall composed of a polyurethane and a polyamide can be prepared by mixing a polyisocyanate, for example, with a second substance which forms the capsule wall by reaction with the polyisocyanate such as an acid chloride, a polyamine and a polyol in an aqueous solution of a water-soluble polymer (the aqueous phase) or in an oil medium (the oil phase) which forms the capsule, dispersing the mixed components to prepare an emulsion and heating the prepared emulsion. This method for preparing a composite wall composed of a polyurea and a polyamide is described in detail in JP-A 58-66948.

As the polyisocyanate compound, compounds having 3 or more functional isocyanate groups are preferable. Bifunctional isocyanate compounds having two functional isocyanate groups may be used in combination.

Specific examples of the polyisocyanate compound include dimers and trimers of diisocyanates (biurets and isocyanurates) which are prepared by using the diisocyanates such as xylylene diisocyanate, hydrogenated xylylene diisocyanate, hexamethylene diisocyanate, tolylene diisocyanate, hydrogenated tolylene diisocyanate and isophorone diisocyanate as the main material; multi-functional adducts of polyols such as trimethylolpropane with bifunctional isocyanates such as xylylene diisocyanate; compounds prepared by introducing macromolecular compounds such as polyethers having active hydrogen atoms, such as polyethylene oxide, into adducts of polyols such as trimethylolpropane with bifunctional diisocyanates such as xylylene diisocyanate; and condensation products of benzene isocyanate with formalin.

The compounds described in JP-A 62-212190, JP-A 4-26189, JP-A 5-317694 and Japanese Patent Application No. 8-268721 are preferable as the polyisocyanate compound.

It is preferable that the polyisocyanate is added so as to provide microcapsules having an average particle diameter in the range of 0.3 to 12 $\mu$m and a thickness of the wall in the range of 0.01 to 0.3 $\mu$m. The diameter of the dispersed particles is generally in the range of 0.2 to 10 $\mu$m.

Specific examples of the polyol and/or the polyamine which is added to the aqueous phase and/or the oil phase as a component which forms the wall of the microcapsule by reaction with the polyisocyanate include propylene glycol, glycerol, trimethylolpropane, triethanolamine, sorbitol and hexamethylenediamine. A polyurethane microcapsule wall is formed when the polyol is added. To increase the reaction rate in the above reaction, it is preferable that the reaction temperature is kept high or that a suitable polymerization catalyst is added.

The polyisocyanate, the polyol, the reaction catalyst and the polyamine used for forming a portion of the wall are described in detail in "Polyurethane Handbook" edited by Keiji Iwata and published by Nikkan Kogyo Shinbun Co., Ltd. (1987).

Metal-containing dyes, electric charge controlling agents such as nigrosin and other optional additives can be contained in the microcapsule wall, if necessary. These additives can be added to the wall during formation of the capsule wall or at any other desired step. A monomer such as a vinyl monomer may be graft polymerized to the capsule wall to control the electric charge at the surface of the wall, if necessary.

It is preferable that a plasticizer suitable for the polymer used as the wall material is used to obtain a microcapsule wall exhibiting excellent permeation of substances at lower temperatures and having an excellent color developing property. The plasticizer preferably has a melting point of 50° C. or higher and more preferably a melting point of 120° C. or lower. Among such plasticizers, a solid plasticizer at an ordinary temperature can be suitably selected and used.

For example, when the wall material is a polyurea or a polyurethane, hydroxy compounds, esters of carbamic acid, aromatic alkoxy compounds, organic sulfonamides, aliphatic amides and arylamides are preferably used.

In the preparation of the oil phase, an organic solvent having a boiling point of 100 to 300° C. is preferably used as the hydrophobic organic solvent used for dissolving the electron-donating dye precursor or the photodecomposable diazo compound and for forming the core of the microcapsule.

Specific examples of the organic solvent include esters, dimethylnaphthalene, diethylnaphthalene, diisopropylnaphthalene, dimethylbiphenyl, diisopropylbiphenyl, diisobutylbiphenyl, 1-methyl-1-dimethylphenyl-2-phenylmethane, 1-ethyl-1-dimethylphenyl-1-phenylmethane, 1-propyl-1-dimethylphenyl-1-phyenylmethane, triarylmethanes such as tritoluylmethane and toluyldiphenylmethane, terphenyl compounds such as terphenyl, alkyl compounds, alkylated diphenyl ethers such as propyl diphenyl ether, hydrogenated terphenyl such as hexahydroterphenyl and diphenyl ethers. Among these solvents, esters are preferably used from the standpoint of stability of the dispersed emulsion.

Examples of the esters include esters of phosphoric acid such as triphenyl phosphate, tricresyl phosphate, butyl phosphate, octyl phosphate and cresyl phenyl phosphate; esters of phthalic acid such as dibutyl phthalate, 2-ethylhexyl phthalate, ethyl phthalate, octyl phathalate and butyl benzyl phthalate; dioctyl tetrahydrophthalate; esters of benzoic acid such as ethyl benzoate, propyl benzoate, butyl benzoate, isopentyl benzoate and benzyl benzoate; esters of abietic acid such as ethyl abietate and benzyl abietate; dioctyl adipate; isodecyl succinate; dioctyl azelate; esters of oxalic acid such as dibutyl oxalate and dipentyl oxalate; diethyl malonate; esters of maleic acid such as dimethyl maleate, diethyl maleate and dibutyl maleate; tributyl citrate; esters of sorbic acid such as methyl sorbate, ethyl sorbate and butyl sorbate; esters of sebacic acid such as dibutyl sebacate and dioctyl sebacate; esters of ethylene glycol such as monoesters and diesters of formic acid, monoesters and diesters of butyric acid, monoesters and diesters of lauric acid, monoesters and diesters of palmitic acid, monoesters and diesters of stearic acid and monoesters and diesters of oleic acid; triacetin; diethyl carbonate; diphenyl carbonate; ethylene carbonate; propylene carbonate; and esters of boric acid such as tributyl borate and tripentyl borate.

Among these esters, tricresyl phosphate is preferable because the emulsion obtained is the most stable when used both singly or in a mixture. The above oils can also be used in combination or in a combination with other oils.

When the solubility of the electron-donating dye precursor or the photodecomposable diazo compound used for the microcapsule in the hydrophobic organic solvent is poor, a solvent having a lower boiling point and exhibiting a better solubility can be used in combination as an auxiliary. Preferable examples of the auxiliary solvent having a lower boiling point include ethyl acetate, isopropyl acetate, butyl acetate and methylene chloride and the like.

When the above electron-donating dye precursor or the photodecomposable diazo compound is used in the heat-sensitive recording layer in the heat-sensitive recording material, the amount of the electron-donating dye precursor is preferably in the range of 0.1 to 5.0 g/m$^2$ and more preferably in the range of 1.0 to 3.5 g/m$^2$.

The amount of the photodecomposable diazo compound is preferably in the range of 0.02 to 5.0 g/m$^2$ and more preferably in the range of 0.10 to 4.0 g/m$^2$ from the standpoint of the density of the developed color.

When the amount of the electron-donating dye precursor is less than 0.1 g/m$^2$ or the amount of the photodecomposable diazo compound is less than 0.02 g/m$^2$, a sufficient density of the developed color is not occasionally obtained. When the amount of the electron-donating dye precursor and that of the photodecomposable diazo compound exceed 5.0 g/m$^2$, transparency of the heat-sensitive recording layer occasionally deteriorates.

As the aqueous phase, an aqueous solution prepared by dissolving a water-soluble polymer contained as the protective colloid is used. The above oil phase material is added to the aqueous solution and dispersed to prepare an emulsion by using devices such as a homogenizer. The water-soluble polymer works as a dispersing medium so that a uniformly dispersed emulsion can be obtained easily and the obtained emulsion is stable. A surfactant may be added to at least one of the oil phase and the aqueous phase to make the emulsion more uniformly dispersed and more stable. A conventional surfactant for emulsification can be used as the surfactant. The added amount of the surfactant is preferably 0.1 to 5% and more preferably 0.5 to 2% of the weight of the oil phase.

As the surfactant added to the aqueous phase, surfactants which do not form precipitates or agglomerates by interaction with the protective colloid can be suitably selected from anionic and nonionic surfactants.

Preferable examples of the surfactant include sodium alkylbenzene-sulfonates, sodium alkylsulfates, sodium salt of dioctyl sulfosuccinate and polyalkylene glycols such as polyoxyethylene nonylphenyl ether.

The emulsion can be easily prepared from the oil phase containing the above components and the aqueous phase containing the protective colloid and the surfactant by a means generally used for microemulsification such as high speed stirring and dispersion by ultrasonic waves using a conventional emulsifying apparatus such as a homogenizer, a Manton Gaulin, an ultrasonic disperser, a dissolver or a KD mill. After emulsification, the formed emulsion is preferably heated to 30 to 70° C. to accelerate the reaction for forming the wall of the capsule. To prevent agglomeration of the capsules during the reaction, it is preferable that water is added to decrease the probability of collision between the capsules and that sufficient stirring is conducted.

An additional amount of the dispersion may be added during the reaction to prevent agglomeration. Generation of carbon dioxide is observed as the polymerization reaction proceeds, and the formation of the wall of the capsule can be considered to be completed around the time when the formation of carbon dioxide ends. The object microcapsules can be obtained generally after the reaction has continued for several hours.

(Dispersed Emulsion)

When capsules are prepared using the electron-donating dye precursor or the photodecomposable diazo compound as the core material, the electron-accepting compound or the coupler may be used in a solid form in combination with the water-soluble polymer, the organic base and other components such as color forming auxiliary agents, by dispersing by a means such as a sand mill. However, it is preferable that, after these components are dissolved into an organic solvent having a high boiling point which is insoluble or slightly soluble in water in advance, the resultant solution is mixed with an aqueous solution of the polymer (the aqueous phase) which contains the surfactant and/or the water-soluble polymer as the protective colloid and the resultant mixture is emulsified by a homogenizer or the like to prepare a dispersed emulsion. A solvent having a low boiling point can be used as an auxiliary agent for dissolution.

The coupler and the organic base may be emulsified and dispersed separately or may be mixed together, dissolved into a solvent having a high boiling point and then emulsified and dispersed. The diameter of the particles in the emulsion is preferably 1 $\mu$m or less.

The organic solvent with a high boiling point used above can be suitably selected, for example, from oils having a high boiling point which are described in JP-A 2-141279.

It is preferable from the standpoint of stability of the dispersed emulsion that esters are used from among these solvents. Tricresyl phosphate is particularly preferable. A combination of the oils described above or a combination of the oils described above with other oils may also be use.

The water-soluble polymer contained as the protective colloid can be suitably selected from conventional anionic polymers, nonionic polymers and amphoteric polymers. A water-soluble polymer having a solubility in water of 5% or more at the temperature of emulsification is preferable. Specific examples of such polymers include polyvinyl alcohol, modified polyvinyl alcohols, polyacrylic amide, derivatives of polyacrylic amide, ethylene-vinyl acetate copolymers, styrene-maleic anhydride copolymers, ethylene-maleic anhydride copolymers, isobutylene-maleic anhydride copolymers, polyvinylpyrolidone, ethylene-acrylic acid copolymers, vinyl acetate-acrylic acid copolymers, derivatives of cellulose such as carboxymethylcellulose and methylcellulose, casein, gelatin, derivatives of starch, gum arabic and sodium alginate.

Among these polymers, polyvinyl alcohol, gelatin and derivatives of cellulose are particularly preferable.

The oil phase is mixed with the aqueous phase preferably in a ratio (the weight of the oil phase/the weight of the aqueous phase) of 0.02 to 0.6 and more preferably in a ratio of 0.1 to 0.4. When the ratio is less than 0.02, the emulsion is excessively dilute due to the excessive amount of the aqueous phase and the emulsion is not suitable for production. When the ratio exceeds 0.6, the emulsion has excessively high viscosity so as to cause inconvenience in handling and a decrease in the stability of the coating solution. Therefore, such ratios are not preferable.

When the electron-accepting compound is used in the heat-sensitive recording material of the present invention, the electron-accepting compound is preferably used in an amount of 0.5 to 30 parts by weight and more preferably 1.0 to 10 parts by weight per 1 part by weight of the electron-donating dye precursor.

When the coupler is used in the heat-sensitive recording material of the present invention, the coupler is preferably used in an amount of 0.1 to 30 parts by weight per 1 part by weight of the diazo compound.

(Coating Solution for the Heat-Sensitive Recording Layer)

The coating solution for the heat-sensitive recording layer can be prepared, for example, by mixing the microcapsule solution and the dispersed emulsion prepared as described above. The water-soluble polymer used as the protective colloid during preparation of the microcapsule solution and the water-soluble polymer used as the protective colloid during preparation of the dispersed emulsion function as a binder in the heat-sensitive recording layer. A binder other than these protective colloids may also be added, mixed, and used to prepare the coating solution for the heat-sensitive recording layer.

A binder soluble in water is generally used as the binder to be added. Examples of the binder include polyvinyl alcohol, hydroxyethylcellulose, hydroxypropylcellulose, epichlorohydrin modified polyamides, ethylene-maleic anhydride copolymers, styrene-maleic anhydride copolymers, isobutylene-maleic anhydride-salicylic acid copolymers, polyacrylic acid, polyacrylamide, methylol modified polyacrylamide, derivatives of starch, casein and gelatin.

To provide the binder with resistance to water, an agent for providing resistance to water or an emulsion of a hydrophobic polymer, such as a styrene-butadiene rubber latex or an acrylic resin emulsion may be added.

To apply the coating solution for the heat-sensitive recording layer onto a substrate, a conventional method for coating a water-based coating solution or an organic solvent-based coating solution is used. In the heat-sensitive recording material of the present invention, methylcellulose, carboxymethylcellulose, hydroxyethylcellulose, starches, gelatin, polyvinyl alcohol, carboxy modified polyvinyl alcohol, polyacrylamide, polystyrene, copolymers of styrene, polyesters, copolymers containing polyesters, polyethylene, copolymers of ethylene, epoxy resins, acrylate resins, copolymer resins of acrylates, methacrylate resins, copolymer resins of methacrylates, polyurethane resins, polyamide resins or polyvinyl butyral resins may be used to achieve safe and uniform application of the coating solution for the heat-sensitive recording layer onto the substrate and to maintain the strength of the resultant coated layer.

(Other Components)

Other components which can be used in the heat-sensitive recording layer will be described hereinafter.

The other components are not particularly limited and can be suitably selected in accordance with the object. For example, conventional heat melting substances, ultraviolet light absorbents and antioxidants can be used.

The heat melting substance may be contained in the heat-sensitive recording layer to improve the response to heat.

Examples of the heat melting substance include aromatic ethers, thioethers, esters, aliphatic amides and ureides.

These compounds are described in JP-A 58-57989, JP-A 58-87094, JP-A 61-58789, JP-A 62-109681, JP-A 62-132674, JP-A 63-151478, JP-A 63-235961, JP-A 2-184489 and JP-A 2-215585.

As the above ultraviolet light absorbent, benzophenone ultraviolet light absorbents, benzotriazole ultraviolet light absorbents, salicylic acid ultraviolet light absorbents, cyanoacrylate ultraviolet light absorbents and oxalic acid anilide ultraviolet light absorbents can be advantageously used. Examples of the above ultraviolet light absorbents are described in JP-A 47-10537, JP-A 58-111942, JP-A 58-212844, JP-A 59-19945, JP-A 59-46646, JP-A 59-109055, JP-A 63-53544, Japanese Patent Publication (hereinafter abbreviated as JP-B) No.36-10466, JP-B 42-26187, JP-B 48-30492, JP-B 48-31255, JP-B 48-41572, JP-B 48-54965, JP-B 50-10726 and U.S. Pat. Nos. 2,719,086, 3,707,375, 3,754,919 and 4,220,711.

As the above antioxidant, hindered amine antioxidants, hindered phenol antioxidants, aniline antioxidants and quinoline antioxidants can be advantageously used. Examples of the antioxidants are described in JP-A 59-155090, JP-A 60-107383, JP-A 60-107384, JP-A 61-137770, JP-A 61-139481 and JP-A 61-160287.

The above-described other components are preferably used in an amount of 0.05 to 1.0 g/m$^2$ and more preferably of 0.1 to 0.4 g/m$^2$. The other components may be contained in the inside or the outside of the microcapsule.

It is preferable that the heat-sensitive recording layer has a large dynamic range, i.e., a large energy range required to obtain the saturated transmission density $D_{T\text{-}max}$, to obtain high quality images by suppressing fluctuations in the density caused by slight differences in the thermal conductivity between heating elements in the thermal head. It is preferable that the heat-sensitive recording material of the present invention includes such a heat-sensitive recording layer and that the heat-sensitive recording layer can exhibit a transmission density $D_T$ of 3.0 with a thermal energy in a range of 90 to 150 mJ/mm$^2$.

It is preferable that the heat-sensitive recording layer is formed so that the layer obtained after the coating solution is applied and dried has a weight of 1 to 25 g/m$^2$ and has a thickness of 1 to 25 $\mu$m.

Substrate

In the heat-sensitive recording material of the present invention, a transparent substrate is preferably used to obtain a transparent heat-sensitive recording material. Examples of the transparent substrate include synthetic polymer films such as polyester films such as a polyethylene terephthalate film and a polybutylene terephthalate film; a cellulose triacetate films; and polyolefin films such as a polypropylene film and a polyethylene film. The above films can be used as a single film or as a laminate of a plurality of films.

The thickness of the film of the synthetic polymer is preferably in the range of 25 to 250 $\mu$m and more preferably in the range of 50 to 200 $\mu$m.

The above synthetic polymer films may be colored to a desired hue. As the method for coloring synthetic polymer films, a method in which a dye is mixed with a resin before preparation of a resin film and then a film is formed by using the colored resin, or a method in which a coating solution is prepared by dissolving a dye into a suitable solvent and the prepared coating solution is applied to a transparent colorless resin film by a conventional method such as gravure coating, roller coating or wire coating, can be used. A polyester resin film (such as a polyethylene terephthalate film or a polyethylene naphthalate film) which is prepared by mixing a polyester resin with a blue dye and forming the mixture into a film, and which is then treated by a treatment for improving heat resistance, a stretching treatment and an antistatic treatment, is preferably used.

When the transparent heat-sensitive recording material of the present invention is observed on an illuminating table with the substrate side facing the observer, it is occasionally difficult to discern the images due to haze formed by the light of the illuminating table passing through transparent portions having no images.

To prevent the above phenomenon, it is preferable that a synthetic polymer film which has a blue color in the quadrangular region formed by four points which are a point A (x=0.2805, y=0.3005), a point B (x=0.2820, y=0.2970), a point C (x=0.2885, y=0.3015) and a point D (x=0.2870, y=0.3040) on the chromaticity coordinate system in accordance with the method described in Japanese Industrial Standard Z8701, is used as the transparent substrate.

Other Layers

The heat-sensitive recording material of the present invention can be formed such that an intermediate layer, a primer layer, an ultraviolet light absorbing filter layer, a light reflection preventing layer or the like is provided as the other layer on the substrate.

(Intermediate Layer)

It is preferable that an intermediate layer is provided on the heat-sensitive recording layer.

The intermediate layer is provided to prevent layer mixing and to cut off gas (e.g., oxygen) which is harmful to image preservability. The binder to be used is not particularly limited and polyvinyl alcohol, gelatin, polyvinyl pyrolidone, derivatives of cellulose and the like can be used depending on the system. Various types of surfactants may also be added in order to facilitate coating. Inorganic fine particles such as mica may be added in an amount of 2 to 20% by weight and more preferably of 5 to 10% by weight of the binder in order to increase gas barrier ability.

(Primer Layer)

In the heat-sensitive recording material of the present invention, it is preferable that the substrate is coated with a primer layer to prevent separation of the heat-sensitive recording layer from the substrate before the substrate is coated with the heat-sensitive recording layer containing the microcapsules and the like and the light reflection preventing layer.

For the primer layer, acrylic ester copolymers, polyvinylidene chloride, SBR and hydrophilic polyesters can be used. The thickness of the layer is preferably 0.05 to 0.5 $\mu$m.

When the heat-sensitive recording layer is coated on the primer layer, images recorded on the heat-sensitive recording layer are occasionally deteriorated by the swelling of the primer layer caused by water contained in the coating solution for the heat-sensitive recording layer. Therefore, it is preferable that a hardening agent such as a dialdehyde such as glutaraldehyde or 2,3-dihydroxy- 1,4-dioxane or boric acid is used in the primer layer to harden the layer. The hardening agent can be used in an amount suitable for providing a desired hardness, i.e., in an amount in the range of 0.2 to 3.0% by weight of the weight of the material of the primer layer.

(Ultraviolet Light Absorbing Filter Layer)

On a back surface of the substrate, i.e., the surface at the side opposite to the coating surface of the heat-sensitive recording layer, an ultraviolet light absorbing filter layer may be provided to prevent color fading of the printed image. In the ultraviolet light absorbing filter layer, an ultraviolet light absorbent such as a benzotriazole ultraviolet light absorbent, a benzophenone ultraviolet light absorbent, or a hindered amine ultraviolet light absorbent is contained.

(Light Reflection Preventing Layer)

A light reflection preventing layer which contains fine particles having an average particle diameter of 1 to 20 $\mu$m and preferably of 1 to 10 $\mu$m may be formed on the back surface of the substrate at the side opposite the side at which the heat-sensitive recording layer is coated.

The gloss measured at an incident light angle of 20° is preferably adjusted to 50% or less and more preferably to 30% or less by forming the light reflection preventing layer.

As the fine particles contained in the light reflection preventing layer, fine particles of starch obtained from barley, wheat, corn, rice or beans; fine particles of synthetic polymers such as cellulose fibers, polystyrene resins, epoxy resins, polyurethane resins, urea-formaldehyde resins, poly (meth)acrylate resins, polymethyl (meth)acrylate resins, copolymer resins of vinyl chloride or vinyl actate and polyolefins; and fine particles of inorganic substances such as calcium carbonate, titanium oxide, kaolin, smectite clay, aluminum hydroxide, silica and zinc oxide, can be used.

A single type or a combination of two or more types of the fine particulate substances can be used. It is preferable that the fine particulate substance has a refractivity index of 1.45 to 1.75 to achieve excellent transparency of the heat-sensitive recording material.

Although the heat-sensitive recording material of the present invention can be produced favorably by a method of producing the heat-sensitive recording material according to the present invention described below, the present invention is not limited thereto and other methods can be used as well.

Since the coating solution for the protective layer contains the emulsion of silicone oil, which is dispersed such that the average particle diameter is 0.15 $\mu$m or less, the heat-sensitive recording material of the present invention has excellent head matching performance and an excellent coated surface without any coating defects. Thus, in particular, the heat-sensitive recording material of the present invention is advantageously used as a recording material in the medical field in which stable formation of high quality images is required.

The method for producing the heat-sensitive recording material of the present invention is described hereinafter.

The method for producing the heat-sensitive recording material of the present invention includes steps of forming a heat-sensitive recording layer on a substrate by coating a coating solution for forming the heat-sensitive recording layer, forming a protective layer by coating a coating solution for forming the protective layer containing at least a pigment and a binder, and forming other layers if necessary.

The heat-sensitive recording layer and the protective layer may be formed simultaneously. In this case, the coating solution for forming the heat-sensitive recording layer and the coating solution for forming the protective layer are coated on the substrate in the same process, so that the heat-sensitive recording layer and the protective layer thereon can be formed in the same process.

According to the method for producing the heat-sensitive recording material of the present invention, an emulsion of silicone oil, which is dispersed such that the average particle diameter is 0.15 $\mu$m or less, is contained in the coating solution for forming the protective layer. Accordingly, the emulsion is safe from being damaged by a shear when passing through a pump or a filter when the liquid is being fed, or by an ultrasonic deaerator. As a result, huge oil droplets, which might cause coating defects due to repelling, are not formed. Thus, this method of production is extremely stable.

As the substrate, the above-described substrate which is used for the heat-sensitive recording material of the present invention may be used. As the coating solution for forming the heat-sensitive recording layer, the above-described coating solution for the heat-sensitive recording layer can be used. Similarly, as the coating solution for forming the protective layer, the above-described coating solution for the protective layer containing the pigment and the binder can be used.

Examples of the other layers include other layers such as the above-described intermediate layer and primer layer.

According to the method for producing the heat-sensitive recording material of the present invention, a conventional coating method such as blade coating, air knife coating, gravure coating, roll coating, spray coating, dip coating or bar coating is used to form the primer layer, the heat-sensitive recording layer, the intermediate layer, the protective layer and the like one after another on the substrate.

By using the heat-sensitive recording material producing method of the present invention, the heat-sensitive recording material of the present invention can be produced.

EXAMPLES

The present invention will be described more specifically with reference to the following Examples. However, the present invention is not limited to these Examples.

Example 1

<Preparation of Coating Solution for Protective Layer>

(Preparation of Pigment Dispersion for Protective Layer)

To 110 g of water, 30 g of aluminum hydroxide treated with stearic acid (trade name: HAIGILITE H42S; manufactured by Showa Denko K.K.) was added as a pigment, and the mixture was stirred for 3 hours. Then, 0.2 g of a dispersant (trade name: POISE 532A; manufactured by Kao Corp.), 30 g of 10% by weight aqueous solution of polyvinyl alcohol (trade name: PVA105; manufactured by Kuraray Co., Ltd.) and 1.0 g of a 10% by weight aqueous solution of sodium dodecylbenzene-sulfonate were added, and the mixture was dispersed by a sand mill to obtain a pigment dispersion for a protective layer having an average particle diameter of 0.30 $\mu$m.

The average particle diameter was measured in accordance with the following procedures: a pigment was dispersed in the presence of an auxiliary dispersant; the pigment dispersion immediately after the pigment was dispersed was diluted to the concentration of 0.5% by weight by adding water; the obtained solution for measurement was placed in water of 40° C.; after the light transmittance was adjusted to 75±1.0%, the solution for measurement was subjected to ultrasonic vibration for 30 seconds and was then subjected to measurement by an apparatus for measuring distribution of particle diameters by laser diffraction (trade name: LA700, manufactured by Horiba Ltd.); and the average particle diameter of pigment particles in an amount corresponding to 50% by volume of the total volume of the pigment was used as the average particle diameter. All values of the average particle diameter used hereinafter were obtained as described above.

(Preparation of Emulsion of Fine Particles of Wax)

To 20.0 g of solid paraffin wax having a melting point of 68 to 70° C. (manufactured by Kanto Kagaku Co., Ltd.), 5.0 g of a surfactant of polyoxyethylene stearyl ether (trade name: KAO EMULGEN 320P, manufactured by Kao Corp.) was added and med while the substances were melted by heating to 75° C. The obtained mixture was added to 60 g of a 5% by weight aqueous solution of polyvinyl alcohol (trade name: PVA205C, manufactured by Kuraray Co., Ltd.) at 75° C. The resultant mixture was emulsified by an ACE HOMOGENIZER (a trade name, manufactured by Nippon Seild Co., Ltd.) at a rotation speed of 15,000 rpm so that the average particle diameter became 0.7 $\mu$m.

During the emulsification, the temperature of the homogenizer was maintained by circulating hot water of 85° C. around the homogenizer so that the emulsification was constantly conducted at a temperature of 75° C. or higher. After the emulsification was completed, 8.3 g of hot water was added, and then the temperature of the solution was gradually decreased to an ordinary temperature to obtain a 30% by weight emulsion of fine particles of wax.

(Preparation of Coating Solution for Protective Layer)

To 20 g of water, 90 g of a 6% by weight aqueous solution of polyvinyl alcohol (trade name: PVA124C, manufactured by Kuraray Co., Ltd.), 0.5 g of a 20.5% by weight dispersion of zinc stearate (trade name: F155, manufactured by Chukyo Yushi Co., Ltd.), 25 g of a 1.0% aqueous solution of boric acid, 3.0 g of the 30% by weight emulsion of fine particles of wax prepared above, 150 g of the pigment dispersion for a protective layer prepared above, 5.0 g of a 30% by weight dispersion of silicone oil in water (polydimethylsiloxane, trade name: BY22-840, manufactured by Toray Dow Corning Co., Ltd., average particle diameter: 0.04 $\mu$m, viscosity: 2000 cps), 2.0 g of a 10% by weight aqueous solution of sodium dodecylbenzenesulfonate, 15 g of a 2% by weight aqueous solution of a compound expressed by the following structural formula (1):

$C_8F_{17}SO_2N(C_3H_7)CH_2COOK$ Structural formula (1)

and 1.0 g of a 40% by weight aqueous solution of glyoxal were mixed together to obtain a coating solution for the protective layer.

<Preparation of Coating Solution for Heat-Sensitive Recording Layer>

A coating solution of microcapsules and an emulsion for a developer were prepared in accordance with the following procedures.

(Preparation of Coating Solution of Microcapsules)

To 36 g of ethyl acetate, 19 g of a compound expressed by the following structural formula (2):

Structural formula (2)

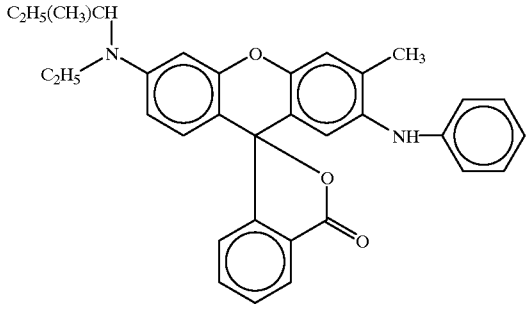

4.2 g of a compound expressed by the following structural formula (3):

Structural formula (3)

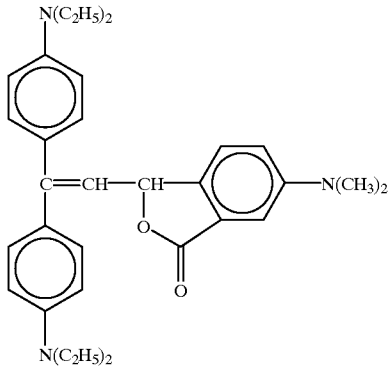

7.4 g of a compound expressed by the following structural formula (4):

Structural formula (4)

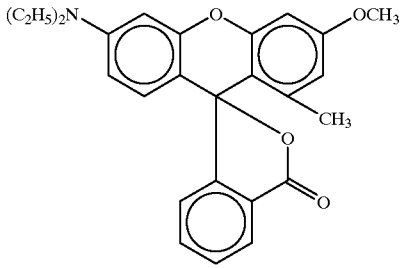

0.6 g of a compound expressed by the following structural formula (5):

Structural formula (5)

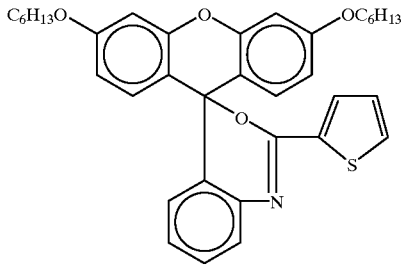

1.9 g of a compound expressed by the following structural formula (6):

Structural formula (6)

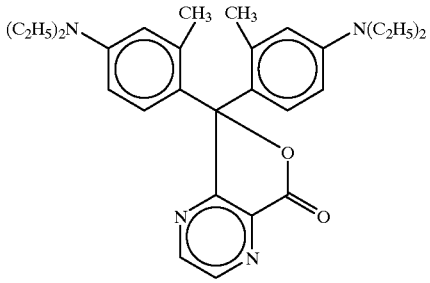

and 0.8 g of a compound expressed by the following structural formula (7):

Structural formula (7)

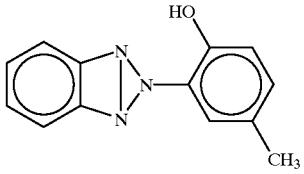

were added as color forming agents and dissolved by heating at 70° C., and the resultant solution was cooled to 35° C. To the cooled solution, 0.8 g of n-butanol and 26.4 g of a material for a capsule wall (trade name: Takenate D127N, manufactured by Takeda Chemical Industries, Ltd.) were added, and the obtained mixture was maintained at 35° C. for 40 minutes.

The resultant solution was added to an aqueous phase which was prepared by mixing 26 g of water and 75 g of an 8% by weight aqueous solution of polyvinyl alcohol (trade name: PVA217E, manufactured by Kuraray Co., Ltd.), and the obtained mixture was emulsified using an ACE HOMOGENIZER (manufactured by Nippon Seild Co., Ltd.) at a rotation speed of 10,000 rpm for 5 minutes. To the obtained emulsion, 140 g of water and 1.0 g of tetraethylenepentamine were added, and the resultant mixture was subjected to the reaction for formation of capsules at 60° C. for 3 hours to prepare a coating solution of microcapsule having an average particle diameter of 0.7 $\mu$m.

(Preparation of Developer Emulsion)

To 15 g of ethyl acetate, 3.4 g of a compound expressed by the following structural formula (8):

Structural formula (8)

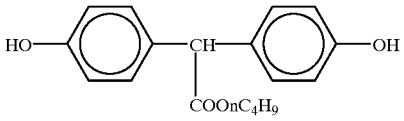

8.3 g of a compound expressed by the following structural formula (9):

Structural formula (9)

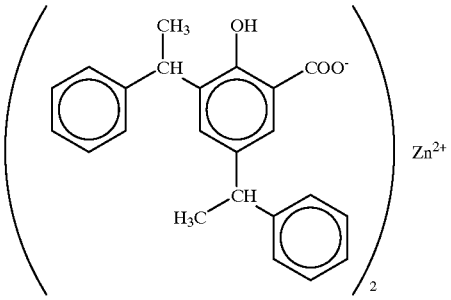

8.3 g of a compound expressed by the following structural formula (10):

Structural formula (10)

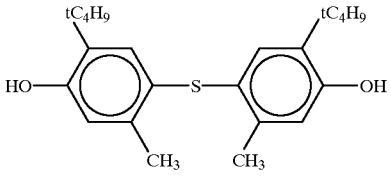

5.8 g of a compound expressed by the following structural formula (11):

Structural formula (11)

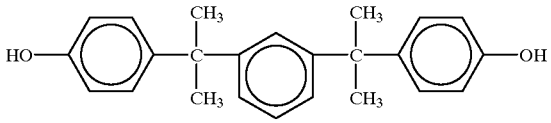

3.9 g of a compound expressed by the following structural formula (12):

Structural formula (12)

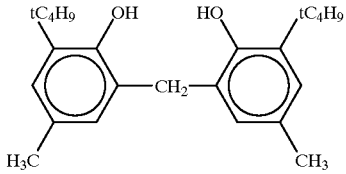

and 3.5 g of a compound expressed by the following structural formula (13):

Structural formula (13)

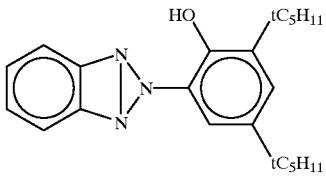

were added as developers together with 0.8 g of tricresyl phosphate and 0.4 g of diethyl maleate and dissolved by heating at 70° C.

The resultant solution was added to an aqueous phase which was prepared by mixing 40 g of a 15% by weight aqueous solution of polyvinyl alcohol (trade name: PVA205C, manufactured by Kuraray Co., Ltd.), 9 g of a 2.0% by weight aqueous solution of sodium dodecylbenzenesulfonate and 9.0 g of a 2% by weight aqueous solution of a compound expressed by the following structural formula (14):

Structural formula (14)

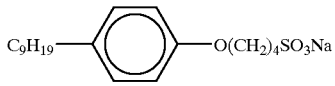

The resultant mixture was emulsified by an ACE HOMOGENIZER (manufactured by Nippon Seiki Co., Ltd.) at a rotation speed of 10,000 rpm so that the average particle diameter became 0.7 $\mu$m and a developer emulsion was obtained.

(Preparation of Coating Solution for Heat-Sensitive Recording Layer)

A coating solution for a heat-sensitive recording layer was prepared by mixing 14.2 g of the coating solution of microcapsules prepared above (concentration of solid components: 27% by weight), 85 g of the developer emulsion prepared above (concentration of solid components: 21% by weight) and 0.4 g of a 50% by weight aqueous solution of a compound expressed by the following structural formula (15):

Structural formula (15)

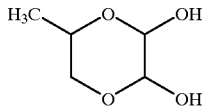

<Preparation of Coating Solution for Intermediate Layer>

A coating solution for an intermediate layer was prepared by dissolving 140 g of a 15% by weight aqueous solution of gelatin (trade name: #750GEL, manufactured by Nitta Gelatin Inc.), 3 g of 10% by weight sodium dodecylbenzenesulfonate as a surfactant, 7 g of 5% by weight sodium polystyrenesulfonate (molecular weight: 760,000, manufactured by Sankyo Chemical Industries, Ltd.) as a viscosity controller, and 21 g of a 2.5% by weight dispersion of mica in 140 g of water.

<Preparation of Coating Solution for Ultraviolet Light Absorbing Filter Layer>

(Preparation of Microcapsule Solution for Ultraviolet Light Absorbing Filter Layer)

To 8.2 g of ethyl acetate, 1.58 g of a compound expressed by the following structural formula (16):

Structural formula (16)

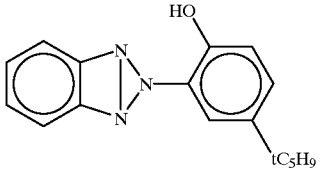

6.30 g of a compound expressed by the following structural formula (17):

Structural formula (17)

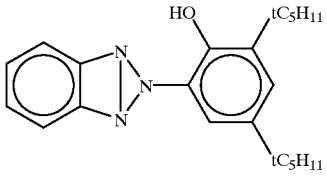

5.20 g of a compound expressed by the following structural formula (18):

Structural formula (18)

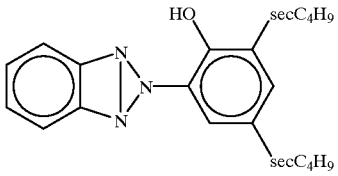

1.40 g of a compound expressed by the following structural formula (19):

Structural formula (19)

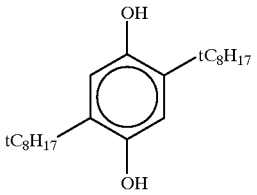

and 7.30 g of a compound expressed by the following structural formula (20):

$O{=}P{-}(OCH_2CH_2CH(CH_3)CH_2C{-}(CH_3)_2CH_3)_3$ Structural formula (20)

were added and dissolved by heating at 70° C. and the resultant solution was cooled to 35° C. To the cooled solution, 0.9 g of a material for a capsule wall (trade name: Takenate D110N, manufactured by Takeda Chemical Industries, Ltd.) and 0.3 g of a material for a capsule wall (trade name: Barnock D750, manufactured by Dainippon Ink & Chemicals, Inc.) were added and the obtained mixture was maintained at 35° C. for 5 minutes. The prepared solution was added to an aqueous phase which was prepared by mixing 120 g of a 15% by weight aqueous solution of polyvinyl alcohol (trade name: PVA205, manufactured by Kuraray Co., Ltd.) and 8.0 g of a 10% by weight aqueous solution of sodium dodecylbenzenesulfonate. The resultant mixture was emulsified by an ACE HOMOGENIZER (manufactured by Nippon Seiki Co., Ltd.) at a rotation speed of 15,000 rpm for 15 minutes to obtain an emulsion having an average particle diameter of 0.25 $\mu$m.

To the resultant emulsion, 60 g of water and 0.15 g of tetraethylenepentamine were added, and the obtained mixture was subjected to the reaction for formation of capsules at 40° C. for 3 hours to prepare a microcapsule solution for an ultraviolet light absorbing filter layer having an average particle diameter of 0.25 $\mu$m.

(Preparation of Coating Solution for Ultraviolet Light Absorbing Filter Layer)

To a solution prepared by dissolving 40.0 g of a 10% by weight solution of silanol modified polyvinyl alcohol (trade name: R2105, manufactured by Kuraray Co., Ltd.) in 42.31 g of water, 13.5 g of the microcapsule solution for an ultraviolet light absorbing filter layer prepared above (concentration of solid components: 24.2%) was added. To the resultant mixture, 17 g of a 50% by weight aqueous solution of a compound expressed by the following structural formula (21):

Structural formula (21)

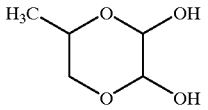

and 65 g of a 20% colloidal silica (trade name: Snowtex O, manufactured by Nissan Chemical Industries, Ltd.) were mixed to prepare a coating solution for an ultraviolet light absorbing filter layer.

<Preparation of Coating Solution for Light Reflection Preventing Layer>

To 50 g of water, 0.1 g of rice starch (manufactured by Matsutani Kagaku Co., Ltd.) having an average particle diameter of 5 μm was added and sufficiently dispersed. To the obtained dispersion, 2.5 g of a 2% by weight aqueous solution of di(2-ethyl)hexyl sulfosuccinate, 1.5 g of a 2% by weight aqueous solution of a compound expressed by the following structural formula (22):

$$C_8F_{17}SO_2N(C_3H_7)CH_2COOK \qquad \text{Structural formula (22)}$$

and 17 g of a 20% by weight colloidal silica (trade name: Snowtex O, manufactured by Nissan Chemical Industries, Ltd.) were mixed to prepare a coating solution for a light reflection preventing layer.

<Preparation of Transparent Substrate>

On one surface of a polyethylene terephthalate (PET) film having a thickness of 175 μm which had a blue color of x=0.2850 and y=0.2995 in accordance with the chromatic coordinate system specified in Japanese Industrial Standard Z8701, SBR latex was applied to a dried coated amount of 0.3 g/m$^2$. Thereon, a solution prepared by mixing 200 g of a 5% by weight aqueous solution of gelatin (Nitta gelatin #810), 0.5 g of a 5% by weight dispersion of polymethyl methacrylate resin particles having a diameter of 2 μm in gelatin (content of polymethyl methacrylate resin: 10% by weight), 1.0 g of a 3% by weight aqueous solution of 1,2-benzothiazoline-3-one and 10 g of a 2% by weight aqueous solution of di(2-ethyl)hexyl sulfosuccinate was coated to a dried coated amount of 0.1 g/m$^2$.

The other surface of the PET film was also coated in the same manner as described above such that the primer layer was formed on both surfaces of the substrate.

<Preparation of Heat-Sensitive Recording Material>

On one surface of the substrate having the primer layers provided on both surfaces, the coating solution for the ultraviolet light absorbing filter layer prepared above was applied in an amount forming a dried layer of 1.8 g/m$^2$ and dried to form the ultraviolet light absorbing filter layer.

On the ultraviolet light absorbing filter layer, the coating solution for the light reflection preventing layer was applied in an amount forming a dried layer of 2.2 g/m$^2$ and dried. Thus, the light reflection preventing layer was formed on the ultraviolet light absorbing filter layer.

Next, on the surface of the substrate at the surface opposite to the surface coated with the ultraviolet light absorbing filter layer and the light reflection preventing layer, the coating solution for a heat-sensitive recording layer was applied in an amount forming a dried layer of 16.5 g/m$^2$ and dried to form a heat-sensitive recording layer.

On the heat-sensitive recording layer, the coating solution for an intermediate layer and the coating solution for a protective layer were applied in that order in amounts forming dried layers of 1.0 g/m$^2$ and 2.5 g/m$^2$ respectively and dried. Thus, an intermediate layer and a protective layer were formed and a transparent heat-sensitive recording material of the present invention was obtained.

<Evaluation of Coating Defects>

The obtained heat-sensitive recording material was visually inspected to determine the presence of coating defects caused by repelling. The coating defects were evaluated by the number of repelled portions per m$^2$ of the protective layer surface. The results are shown in Table 1.

<Evaluation of Head Matching Performance>

Recording on the obtained heat-sensitive recording material was carried out by using a thermal head (trade name: KGT, 260-12MPH8, manufactured by Kyocera Corp.) under a head pressure of 10 kg/cm$^2$ with a recording energy of 120 mJ/mm$^2$. The heat-sensitive recording material was then visually inspected to determine the presence of sticking, i.e., adhesion of the protective layer of the heat-sensitive recording material to the thermal head during printing. The heat-sensitive recording materials which did not result in sticking received an evaluation of ○, and those which resulted in sticking received an evaluation of X. The results are shown in Table 1.

Moreover, the presence of fouling on the thermal head after recording was visually evaluated. The heat-sensitive recording materials which did not leave any fouling on the head heating element received an evaluation of ○, and those which did leave fouling received an evaluation of X. The results are shown in Table 1.

<Measurement of d2>

The 30% by weight dispersion of silicone oil in water (polydimethylsiloxane, trade name: BY22-840, manufactured by Toray Dow Corning Co., Ltd., average particle diameter: 0.04 μm, viscosity: 2000 cps) used to prepare the coating solution for the protective layer was diluted 50 fold with water. Then, the average particle diameter d2 of the resultant silicone oil was measured.

<Measurement of d3>

The 30% by weight dispersion of silicone oil in water (polydimethylsiloxane, trade name: BY22-840, manufactured by Toray Dow Corning Co., Ltd., average particle diameter: 0.04 μm, viscosity: 2000 cps) used to prepare the coating solution for the protective layer was diluted 50 fold with water and irradiated by ultrasonic waves with an output power of 100 W at 40 Hz for 30 minutes. Then, the average particle diameter d3 of the resultant silicone oil was measured.

<Measurement of d4>

The 30% by weight dispersion of silicone oil in water (polydimethylsiloxane, trade name: BY22-840, manufactured by Toray Dow Corning Co., Ltd., average particle diameter: 0.04 μm, viscosity: 2,000 cps) used to prepare the coating solution for a protective layer was diluted 50 fold with water and stirred for 10 minutes by an ACE HOMOGENIZER (trade name, manufactured by Nippon Seild Co., Ltd.) at a rotation speed of 5,000 rpm. Then, the average particle diameter d4 of the resultant silicone oil was measured.

Example 2

A heat-sensitive recording material was prepared in accordance with the same procedures as those followed in Example 1 except that a 30% by weight dispersion of silicone oil in water (carboxy modified polydimethylsiloxane, trade name: BY22-835, manufactured by Toray Dow Corning Co., Ltd., average particle diameter: 0.05 μm, viscosity: 40,000 cps) was used in place of the 30% by weight dispersion of silicone oil in water (polydimethylsiloxane, trade name: BY22-840, manufactured by Toray Dow Corning Co., Ltd., average particle diameter: 0.04 μm, viscosity: 2,000 cps). Then, the resultant heat-sensitive recording material was evaluated in the same manner as Example 1. By using the dispersion of silicone oil in water, d2, d3 and d4 were measured in the same manner as Example 1. The results are shown in Table 1.

Comparative Example 1

A heat-sensitive recording material was prepared in accordance with the same procedures as those followed in Example 1 except that a 30% by weight dispersion of silicone oil in water (polydimethylsiloxane, trade name: KM788, manufactured by Shin-Etsu Silicone Co., Ltd., average particle diameter: 0.38 μm, viscosity: 10,000 cps) was used in place of the 30% by weight dispersion of silicone oil in water (polydimethylsiloxane, trade name: BY22-840, manufactured by Toray Dow Corning Co., Ltd., average particle diameter: 0.04 μm, viscosity: 2,000 cps). Then, the resultant heat-sensitive recording material was evaluated in the same manner as Example 1. By using the dispersion of silicone oil in water, d2, d3 and d4 were measured in the same manner as Example 1. The results are shown in Table 1.

Comparative Example 2

A heat-sensitive recording material was prepared in accordance with the same procedures as those followed in Example 1 except that a 30% by weight dispersion of silicone oil in water (polydimethylsiloxane, trade name: SH490, manufactured by Toray Dow Corning Co., Ltd., average particle diameter: 0.35 μm, viscosity: 100,000 cps) was used in place of the 30% by weight dispersion of silicone oil in water (polydimethylsiloxane, trade name: BY22-840, manufactured by Toray Dow Corning Co., Ltd., average particle diameter: 0.04 μm, viscosity: 2,000 cps). Then, the resultant heat-sensitive recording material was evaluated in the same manner as Example 1. By using the dispersion of silicone oil in water, d2, d3 and d4 were measured in the same manner as Example 1. The results are shown in Table 1.

TABLE 1

| | Lubricant | Viscosity (CPS) | d1 | d2 | d3 | d4 | Head Matching Performance sticking | Head Matching Performance fouling | Coating Defects (number/m$^2$) |
|---|---|---|---|---|---|---|---|---|---|
| Example 1 | Polydimethylsiloxane | 2,000 | 0.04 | 0.04 | 0.04 | 0.05 | ○ | ○ | 0 |
| Example 2 | Carboxy Modified Polydimethylsiloxane | 40,000 | 0.05 | 0.05 | 0.05 | 0.06 | ○ | ○ | 0 |
| Comparative Example 1 | Polydimethylsiloxane | 10,000 | 0.38 | 0.41 | 0.61 | 0.75 | ○ | ○ | 4 |
| Comparative Example 2 | Polydimethylsiloxane | 100,000 | 0.35 | 0.38 | 0.55 | 0.63 | ○ | ○ | 3 |

As shown in the results in Table 1, while heat-sensitive recording materials having an excellent head matching performance and a surface which is coated well without any coating defects could be obtained from Examples 1 and 2, coating defects due to repelling occurred in Comparative Examples 1 and 2. The dispersants of silicone oil in water used in Examples 1 and 2 did not cause damage to the emulsion and were stable even after strong stirring or ultrasonic irradiation. In contrast, it is clear that in the dispersants of silicone oil in water used in Comparative Examples 1 and 2, damage to the emulsion was caused by strong stirring or ultrasonic irradiation, thereby forming huge oil droplets. These huge oil droplets cause coating defects due to repelling.

According to the present invention, a heat-sensitive recording material having an excellent head matching performance and a surface which is coated well without any coating defects can be provided. Moreover, according to the present invention, a method for producing an advantageous heat-sensitive recording material such as those described above can be provided.

What is claimed is:

1. A heat-sensitive recording material comprising a substrate, and a heat-sensitive recording layer and a protective layer disposed on said substrate in that order, wherein the protective layer is formed by applying a coating solution for the protective layer containing a pigment, a binder, and an emulsion of silicone oil, wherein the silicone oil is dispersed so that an average particle diameter of the silicone oil is 0.15 μm or less.

2. A heat-sensitive recording material according to claim 1, wherein said silicone oil satisfies a relational expression $d2/d1 \leqq 1.5$, where d1 is the average particle diameter of the silicone oil in the emulsion and d2 is the average particle diameter of the silicone oil after the emulsion of the silicone oil is diluted 50 fold with water.

3. A heat-sensitive recording material according to claim 2, wherein said silicone oil is at least one type of silicone oil selected from the group consisting of ether modified silicone oil, carboxy modified silicone oil and amino modified silicone oil.

4. A heat-sensitive recording material according to claim 3, wherein said silicone oil has a viscosity within a range from 400 to 100,000 cps.

5. A heat-sensitive recording material according to claim 2, wherein said silicone oil has a viscosity within a range from 400 to 100,000 cps.

6. A heat-sensitive recording material according to claim 1, wherein said silicone oil satisfies a relational expression $d3/d1 \leqq 1.5$, where d1 is the average particle diameter of the silicone oil in the emulsion and d3 is the average particle diameter of the silicone oil after the emulsion of the silicone oil is diluted 50 fold with water and then irradiated by ultrasonic waves with an output power of 100 W at 40 Hz for 30 minutes.

7. A heat-sensitive recording material according to claim 6, wherein said silicone oil is at least one type of silicone oil selected from the group consisting of ether modified silicone oil, carboxy modified silicone oil and amino modified silicone oil.

8. A heat-sensitive recording material according to claim 7, wherein said silicone oil has a viscosity within a range from 400 to 100,000 cps.

9. A heat-sensitive recording material according to claim 6, wherein said silicone oil has a viscosity within a range from 400 to 100,000 cps.

10. A heat-sensitive recording material according to claim 1, wherein said silicone oil satisfies a relational expression $d4/d1 \leqq 1.5$, where d1 is the average particle diameter of the silicone oil in the emulsion and d4 is the average particle diameter of the silicone oil after the emulsion of the silicone oil is diluted 50 fold with water and then stirred by a homogenizer at 5000 rpm for 10 minutes.

11. A heat-sensitive recording material according to claim 10, wherein said silicone oil is at least one type of silicone oil selected from the group consisting of ether modified silicone oil, carbon modified silicone oil and amino modified silicone oil.

12. A heat-sensitive recording material according to claim 10, wherein said silicone oil has a viscosity within a range from 400 to 100,000 cps.

13. A heat-sensitive recording material according to claim 1, wherein said silicone oil is at least one type of silicone oil selected from the group consisting of ether modified silicone oil, carboxy modified silicone oil and amino modified silicone oil.

14. A heat-sensitive recording material according to claim 13, wherein said silicone oil has a viscosity within a range from 400 to 100,000 cps.

15. A heat-sensitive recording material according to claim 1, wherein said silicone oil has a viscosity within a range from 400 to 100,000 cps.

16. A heat-sensitive recording material comprising a substrate, and a heat-sensitive recording layer and a protective layer disposed on said substrate in that order, wherein the protective layer is formed by applying a coating solution for the protective layer containing a pigment, a binder, and an emulsion of silicone oil, wherein the silicone oil is dispersed so that d1 is 0.10 $\mu$m or less, and the silicone oil satisfies a relational expression $0.8<d2/d1<1.2$, where d1 is the average particle diameter of the silicone oil in the emulsion and d2 is the average particle diameter of the silicone oil after the emulsion of the silicone oil is diluted 50 fold with water.

17. A method for producing a heat-sensitive recording material comprising the steps of:

(a) forming a heat-sensitive recording layer on a substrate by applying a coating solution for forming the heat-sensitive recording layer; and (b) forming a protective layer on the heat-sensitive recording layer by applying another coating solution for forming the protective layer containing at least a pigment and a binder, wherein said coating solution for forming the protective layer contains an emulsion of silicone oil, wherein the silicone oil is dispersed so that an average particle diameter of the silicone oil is 0.15 $\mu$m or less.

18. A method for producing a heat-sensitive recording material according to claim 17, wherein said silicone oil satisfies a relational expression $d2/d1 \leqq 1.5$, where d1 is the average particle diameter of the silicone oil in the emulsion and d2 is the average particle diameter of the silicone oil after the emulsion of the silicone oil is diluted 50 fold with water.

19. A method for producing a heat-sensitive recording material according to claim 17, wherein said step of applying another coating solution on the heat sensitive recording layer includes preparing said silicone oil so as to have a viscosity within a range from 400 to 100,000 cps.

20. A method for producing a heat-sensitive recording material according to claim 17, further comprising the step of selecting said silicone oil to be at least one type of silicone oil selected from the group consisting of ether modified silicone oil, carboxy modified silicone oil and amino modified silicone oil.

* * * * *